US011550248B2

(12) United States Patent
Ueki et al.

(10) Patent No.: US 11,550,248 B2
(45) Date of Patent: Jan. 10, 2023

(54) IMAGE FORMING APPARATUS AND METHOD FOR CONTROLLING THE SAME

(71) Applicant: BROTHER KOGYO KABUSHIKI KAISHA, Nagoya (JP)

(72) Inventors: Shunsuke Ueki, Nagoya (JP); Tomonori Watanabe, Ichinomiya (JP); Mingguang Zhang, Nagoya (JP); Yusuke Mizuno, Nagoya (JP); Shintaro Sakaguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/551,286

(22) Filed: Dec. 15, 2021

(65) Prior Publication Data

US 2022/0197195 A1 Jun. 23, 2022

(30) Foreign Application Priority Data

Dec. 22, 2020 (JP) ..... JP2020-212294

(51) Int. Cl.
*G03G 15/20* (2006.01)
*G03G 15/00* (2006.01)

(52) U.S. Cl.
CPC ..... *G03G 15/205* (2013.01); *G03G 15/2064* (2013.01); *G03G 15/5045* (2013.01); *G03G 2215/2032* (2013.01)

(58) Field of Classification Search
CPC ..... G03G 15/205; G03G 15/2064; G03G 15/5045; G03G 2215/2032
See application file for complete search history.

(56) References Cited

U.S. PATENT DOCUMENTS 5,448,339 A * 9/1995 Kokaji ..... G03G 15/205 399/68
2008/0181644 A1 7/2008 Wagatsuma
2009/0290888 A1* 11/2009 Mukai ..... G03G 15/2039 399/33
2010/0054785 A1* 3/2010 Ogiso ..... G03G 15/2039 399/69
2013/0177330 A1* 7/2013 Aoki ..... G03G 15/2039 399/68

(Continued)

FOREIGN PATENT DOCUMENTS

EP 0722129 A2 * 7/1996 ..... G03G 15/2039
JP 2000-227731 A 8/2000
JP 2008-191182 A 8/2008

(Continued)

*Primary Examiner* — Sevan A Aydin
(74) *Attorney, Agent, or Firm* — Merchant & Gould P.C.

(57) ABSTRACT

An image forming apparatus includes a fixing device including a heating roller configured to heat a sheet when the heating roller rotates, a temperature sensor configured to detect a temperature of the heating roller; and a controller configured to obtain a temperature detected by the temperature sensor at intervals of a predetermined sampling time, calculate, at the intervals of the predetermined sampling time, a temperature-decrease-amount of the detected temperature over a unit time that is longer than the predetermined sampling time, and stop rotation of the heating roller when the calculated temperature-decrease-amount is greater than a predetermined threshold value.

17 Claims, 4 Drawing Sheets

(56) References Cited

U.S. PATENT DOCUMENTS

| | | | | |
|---|---|---|---|---|
| 2014/0161473 | A1* | 6/2014 | Oi | G03G 15/2039 399/33 |
| 2020/0379384 | A1* | 12/2020 | Sam | G03G 15/2053 |

FOREIGN PATENT DOCUMENTS

| | | | | |
|---|---|---|---|---|
| JP | 2009204784 | A * | 9/2009 | G03G 15/2039 |
| JP | 4517562 | B2 * | 8/2010 | G03G 15/201 |

* cited by examiner

IMAGE FORMING APPARATUS AND METHOD FOR CONTROLLING THE SAME

CROSS REFERENCE TO RELATED APPLICATION

The present application claims priority from Japanese Patent Application No. 2020-212294, which was filed on Dec. 22, 2020, the disclosure of which is herein incorporated by reference in its entirety.

BACKGROUND

The following disclosure relates to an image forming apparatus forming an image on a sheet while conveying the sheet.

There have been known an image forming apparatus including a fixing device having a heating roller, a temperature sensor configured to detect a temperature of the heating roller, and a controller. In this technique, the controller is configured to calculate a temperature gradient value in temperature change of the heating roller based on results of temperatures at the heating roller detected by the temperature sensor, and determine whether a sheet is wound around the heating roller or not based on the calculated temperature gradient value and elapsed time of the temperature gradient value detected by a timer.

SUMMARY

Incidentally, winding of the sheet around the heating roller causes further winding in a case where time elapsed from the occurrence of the winding increases; therefore, it is preferable that conveyance of the sheet is stopped immediately when the winding occurs. On the other hand, the temperature detected by the temperature sensor largely changes suddenly due to disturbance and the like. In this case, when it is determined that the temperature of the heating roller is largely decreased due to the change of the temperature, there is a possibility of false detection that the winding has occurred.

An aspect of the disclosure relates to an image forming apparatus and a method capable of immediately stopping conveyance of the sheet when winding of the sheet around the heating roller occurs and capable of suppressing false detection that the winding has occurred.

In one aspect of the disclosure, an image forming apparatus includes a fixing device including a heating roller configured to heat a sheet when the heating roller rotates, a temperature sensor configured to detect a temperature of the heating roller, and a controller configured to obtain a temperature detected by the temperature sensor at intervals of a predetermined sampling time, calculate, at the intervals of the predetermined sampling time, a temperature-decrease-amount of the detected temperature over a unit time that is longer than the predetermined sampling time, and stop rotation of the heating roller when the calculated temperature-decrease-amount is greater than a predetermined threshold value.

In another aspect of the disclosure, a method for controlling an image forming apparatus including a heating roller configured to heat a sheet when the heating roller rotates includes detecting a temperature of the heating roller at intervals of a predetermined sampling time in a state in which the heating roller rotates, obtaining, at the intervals of the predetermined sampling time, a temperature-decrease-amount of the detected temperature of the heating roller over a unit time that is longer than the predetermined sampling time, stopping rotation of the heating roller when the temperature-decrease-amount is greater a predetermined threshold value.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Hereinafter, an embodiment of the present disclosure will be explained in detail suitably with reference to the drawings.

Figure 1:
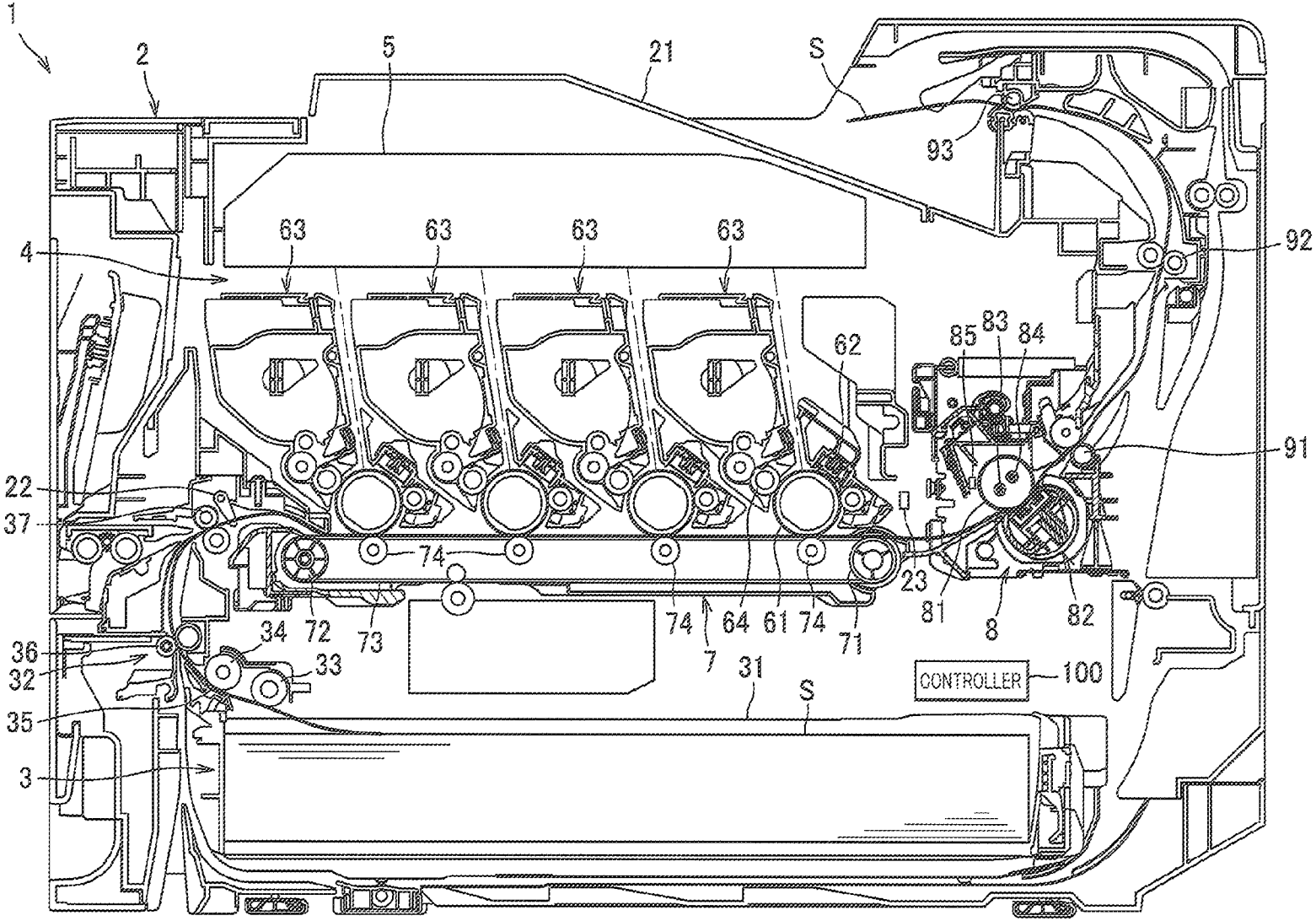
FIG. 1 is a view illustrating a configuration of an image forming apparatus according to an embodiment.

As illustrated in FIG. 1, an image forming apparatus 1 is an apparatus configured to form an image on a sheet S while conveying the sheet S. The image forming apparatus 1 is a color printer capable of forming a color image, and includes a sheet supplier 3, an image forming unit 4, a sensor-after-registration 22, an inner-temperature sensor 23, and a controller 100, each of which is disposed inside a housing 2. The housing 2 includes an output tray 21 on an upper surface thereof.

The sheet supplier 3 has a function of supplying the sheet S to the image forming unit 4. The sheet supplier 3 includes a supply tray 31 that can accommodate a plurality of sheets S and a sheet supply mechanism 32. The sheet supply mechanism 32 includes a pickup roller 33, a separation roller 34, a separation pad 35, a conveying roller 36, and a registration roller 37.

The sheet supplier 3 is configured to convey the sheet S accommodated in the supply tray 31 by the pickup roller 33, separate the sheet S one by one by the separation roller 34 and the separation pad 35, and convey the sheet S toward the registration roller 37 by the conveying roller 36. After that, the sheet supplier 3 is configured to adjust a position of a distal end of the sheet S by the registration roller 37 to thereby correct the skew of the sheet S and supply the sheet S to the image forming unit 4.

The image forming unit 4 has a function of forming the image on the sheet S. The image forming unit 4 includes an exposing unit 5, photoconductive drums 61, charging units 62, developing cartridges 63, a transfer unit 7, and a fixing device 8. The image forming unit 4 includes four photoconductive drums 61, four charging units 62, and four developing cartridges 63.

The exposing unit 5 includes a plurality of light sources, polygon mirrors, lenses, reflection mirrors, and the like which are not illustrated. The exposing unit 5 is configured to expose a surface of each of the photoconductive drums 61 by emitting a light beam (refer to long and short dashed lines) generated based on image data to thereby form an electrostatic latent image on each of the surfaces of the photoconductive drums 61.

The photoconductive drum 61 is a member in which a photoconductive layer is formed on an outer circumference of a cylindrical drum body having conductivity. The four photoconductive drums 61 are arranged side by side in a conveying direction of the sheet S.

The charging unit 62 has a function of charging the surface of each of the photoconductive drums 61. The charging unit 62 includes a charging wire, a grid electrode and the like.

Each of the developing cartridges 63 includes a developing roller 64 capable of bearing toner. The developing cartridges 63 respectively contain toner of yellow, magenta, cyan, and black.

The transfer unit 7 includes a drive roller 71, a driven roller 72, a conveying belt 73, and four transfer rollers 74. The conveying belt 73 is an endless belt, which is wound around between the drive roller 71 and the driven roller 72. The conveying belt 73 is held and interposed between each of the transfer rollers 74 disposed inside the conveying belt 73 and a corresponding one of the photoconductive drums 61.

The fixing device 8 has a function of fixing a toner image on the sheet S. The fixing device 8 includes a heating roller 81, a pressure unit 82, a first heater 83, a second heater 84, and a temperature sensor 85. The heating roller 81 is a roller configured to heat the sheet S. The pressure unit 82 is disposed such that the pressure unit 82 is configured to cooperate with the heating roller 81 to nip the sheet S therebetween, and has a function of applying a pressure to the sheet S with the heating roller 81. The heaters 83, 84 are disposed inside the heating roller 81. The heaters 83, 84 are, for example, halogen heaters configured to generate heat when energized and heat the heating roller 81. The details of the fixing device 8 will be described later.

The image forming unit 4 causes the surfaces of the photoconductive drums 61 to be charged by the charging units 62 and to be exposed by the exposing unit 5. Accordingly, electrostatic latent images generated based on image data are formed on the surfaces of the photoconductive drums 61. Next, the image forming unit 4 supplies toner to the electrostatic latent images formed on the photoconductive drums 61 from the developing rollers 64. Accordingly, toner images are formed on the photoconductive drums 61.

Next, the image forming unit 4 causes the sheet S supplied from the sheet supplier 3 to pass between the photoconductive drums 61 and the transfer rollers 74 while conveying the sheet S by the conveying belt 73 to thereby transfer the toner images formed on the photoconductive drums 61 to the sheet S. Accordingly, the toner image is formed on the sheet S.

After that, the image forming unit 4 fixes the toner image on the sheet S by conveying the sheet S on which the toner image is formed between the heating roller 81 and the pressure unit 82. Accordingly, an image is formed on the sheet S. The sheet S on which the image is formed is conveyed by the conveying rollers 91, 92 and discharged to the output tray 21 by an output roller 93.

The sensor-after-registration 22 has a function of detecting the sheet S supplied from the sheet supplier 3 toward the image forming unit 4. The sensor-after-registration 22 is disposed downstream of the registration roller 37 in the conveying direction of the sheet S. To explain in detail, the sensor-after-registration 22 is disposed between the registration roller 37 and the photoconductive drum 61 which is one photoconductive drum 61 disposed on the most upstream side of the four photoconductive drums 61 in the conveying direction of the sheet S.

As the sensor-after registration-22, for example, a sensor including a lever configured to pivot when the sheet S contacts the lever and an optical sensor configured to detect a position of the lever can be used. The sensor-after-registration 22 outputs a detection signal to the controller 100 when detecting the sheet S, and outputs a non-detection signal to the controller 100 when not detecting the sheet S. It does not matter which voltage is higher in the detection signal and the non-detection signal.

The inner-temperature sensor 23 is a sensor configured to detect a temperature inside the image forming apparatus 1, in detail, an inner-temperature as a temperature inside the housing 2, and the inner-temperature sensor 23 is disposed at a proper position inside the housing 2. As the inner-temperature sensor 23, for example, a thermistor or the like can be used. The inner-temperature sensor 23 outputs a detected result (an inner-temperature TM) to the controller 100.

Next, the details of the fixing device 8 will be explained.

Figure 2:
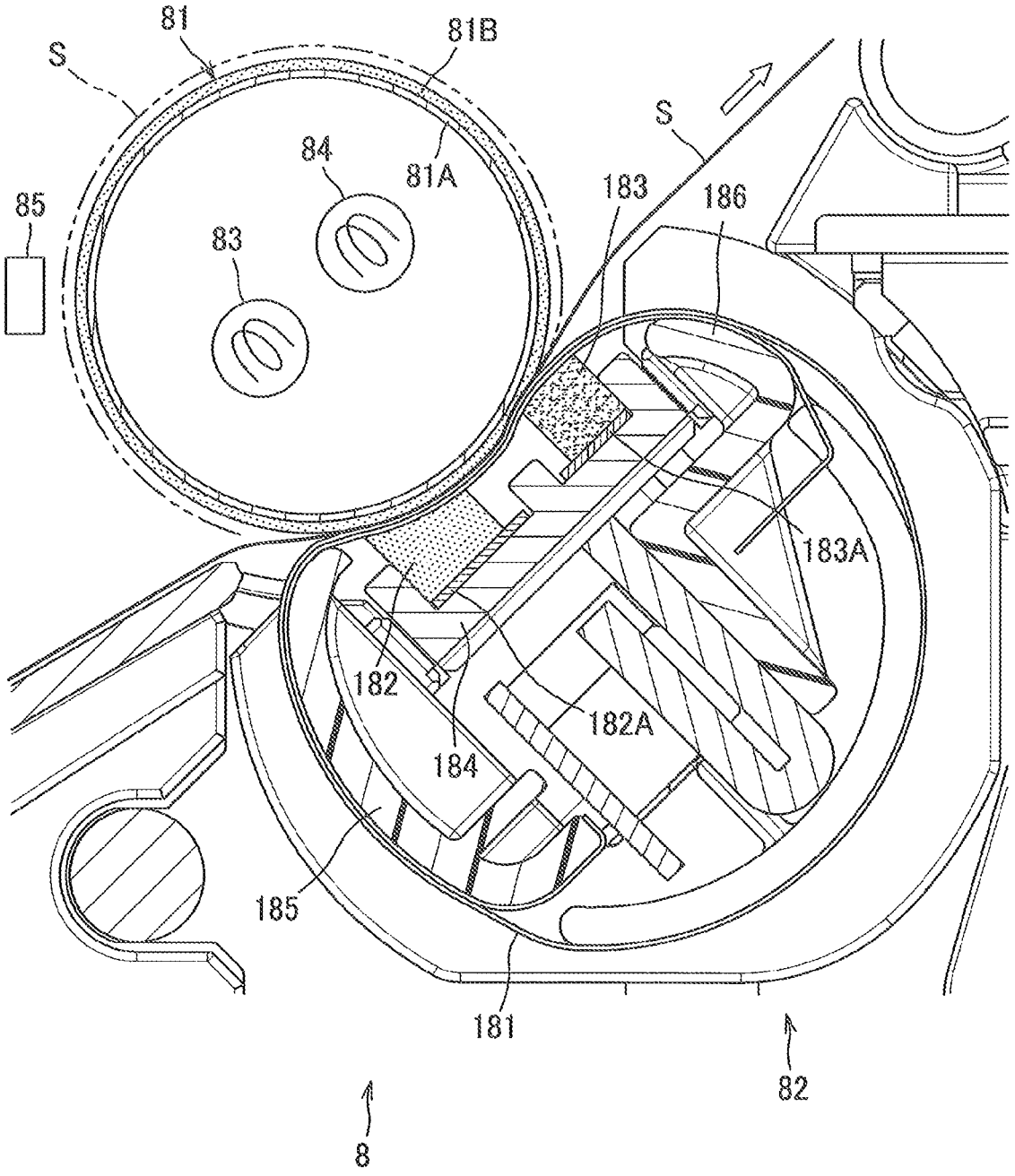
FIG. 2 is a view illustrating a configuration of a fixing device.

As illustrated in FIG. 2, the heating roller 81 includes a tube blank 81A made of metal and an elastic layer 81B formed on an outer circumference of the tube blank 81A. In other words, the heating roller 81 has the elastic layer 81B on the outer circumference thereof. The elastic layer 81B is made of rubber such as silicone rubber, having elasticity. The heating roller 81 is rotatably supported by a not-illustrated frame of the fixing device 8, and the heating roller 81 rotates when a rotation drive force is inputted.

The pressure unit 82 includes an endless belt 181, a first member 182, a second member 183, a support member 184, and belt guides 185, 186.

The endless belt 181 is a belt configured to convey the sheet S in a state in which the sheet S is nipped between the endless belt 181 and the heating roller 81, and the endless belt 181 is made of metal.

The first member 182 and the second member are members each cooperates with the heating roller 81 to nip the endless belt 181 therebetween. The first member 182 and the second member 183 are, for example, made of rubber such as silicone rubber and have elasticity in the same manner as the elastic layer 81B of the heating roller 81. The first member 182 is softer than the elastic layer 81B and the second member 183 is harder than the elastic layer 81B. In other words, the elastic layer 81B of the heating roller 81 is harder than the first member 182 and softer than the second member 183. The first member 182 and the second member 183 may be made of an elastic material such as silicon rubber, felt, leaf spring, or the like.

The first member 182 and the second member 183 are arranged side by side in the conveying direction of the sheet S. To explain in detail, the second member 183 is disposed downstream of the first member 182 in the conveying direction of the sheet S.

The support member 184 is a member supporting the first and second member 182, 183. The first member 182 is fixed to a first support plate 182A and supported by the support member 184 through the first support plate 182A. The second member 183 is fixed to a second support plate 183A and supported by the support member 184 through the second support plate 183A.

The belt guides 185, 186 are members rotatably guiding the endless belt 181. The endless belt 181 is driven to rotate together with the heating roller 81 by rotation of the heating roller 81.

The temperature sensor 85 is a sensor configured to detect a temperature of the heating roller 81. To explain in detail, the heating roller 81 has a central area including a central portion in a width direction of the sheet S which is the direction orthogonal to the conveying direction of the sheet S, and the temperature sensor 85 detects a temperature at the central area of the heating roller 81. The temperature sensor 85 is disposed at the outside of the heating roller 81, which is a position opposed to the central area, in the width direction of the sheet S, of the heating roller 81.

The heating roller 81 also has a contact area at which the heating roller 81 comes into contact with the sheet S, a size of which is a conveyable minimum size when the sheet S having the minimum size in the width direction of the sheet S is conveyed. The conveyable minimum size is a size of the sheet which is the minimum sheet conveyable by the image forming unit 4. The temperature sensor 85 is configured to detect a temperature at the contact area of the heating roller 81. The contact area is an area including the central area in the width direction of the sheet S.

The temperature sensor 85 does not comes into contact with the heating roller 81. In other words, the temperature sensor 85 detects the temperature of the heating roller 81 in a state in which the temperature sensor 85 is not in contact with the heating roller 81. To explain in detail, the temperature sensor 85 is disposed spaced apart from the heating roller 81. As the temperature sensor 85, for example, a non-contact type thermistor or the like can be used. The temperature sensor 85 outputs a detected result (a detected temperature TH) to the controller 100.

The controller 100 (see FIG. 1) includes a CPU, a RAM, a ROM, an input/output circuit, and the like, and the controller 100 is configured to execute control by executing various calculation processes based on programs and data stored in the ROM and the like.

Figure 3:
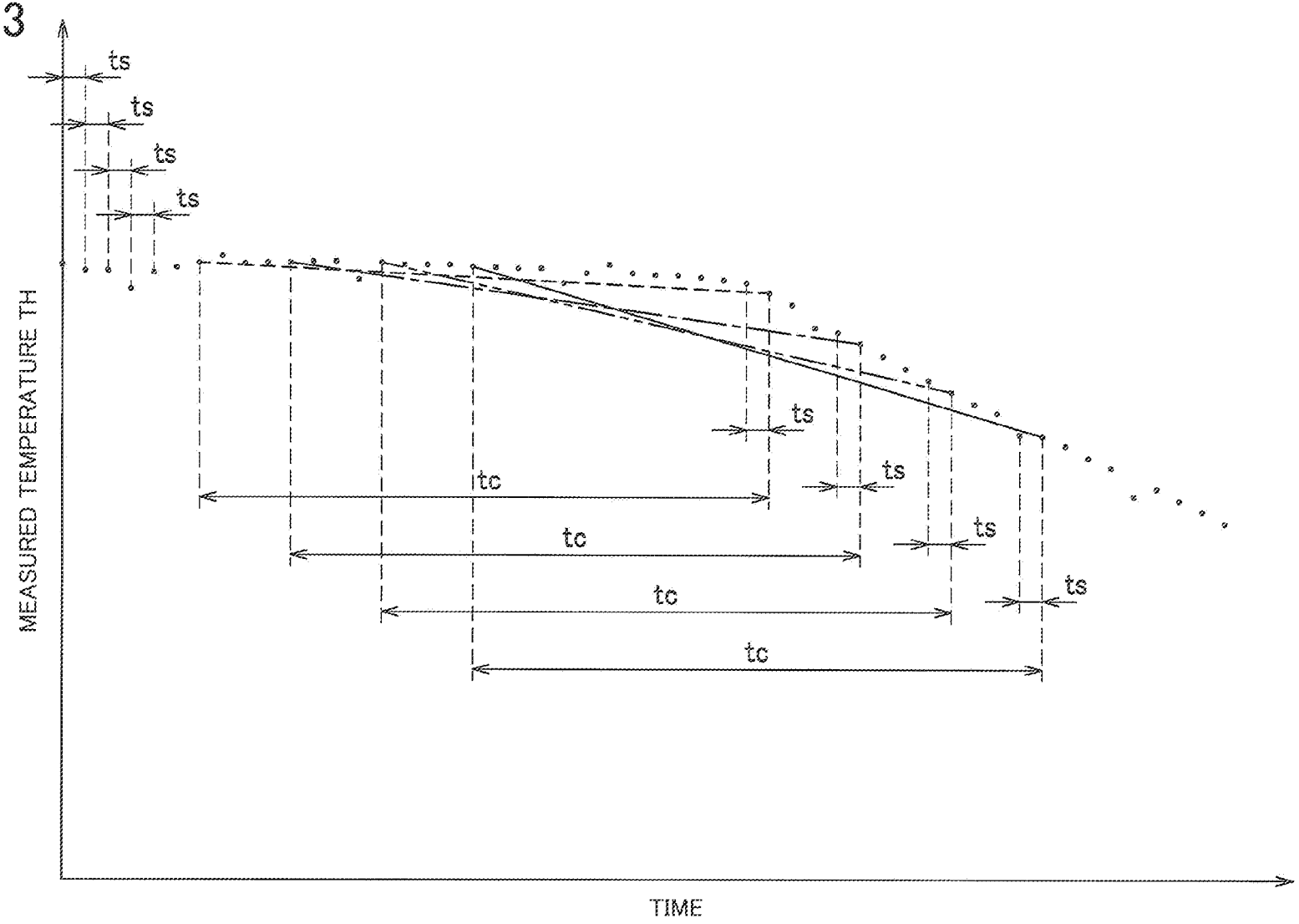
FIG. 3 is a timing chart illustrating an example of detected temperatures by a temperature sensor.

As illustrated in FIG. 3, the controller 100 is configured to obtain the detected temperature TH detected by the temperature sensor 85 at intervals of a predetermined sampling time "ts". To explain in detail, the controller 100 obtains the detected temperature TH at the intervals of the sampling time "ts" after a power supply is inputted to the image forming apparatus 1. The sampling time "ts" is, for example, several tens of milliseconds.

In a case where the sheet S (refer to a virtual line in FIG. 2) is wound around the heating roller 81 while printing in which the image is formed on the sheet S is in process, the sheet S enters between the heating roller 81 and the temperature sensor 85; therefore, the detected temperature TH detected by the temperature sensor 85 decreases rapidly. Accordingly, the controller 100 calculates a temperature-decrease-amount TD of the detected temperature TH in a predetermined unit time "tc" at the intervals of the sampling time "ts", and stops conveyance of the sheet S when the calculated temperature-decrease-amount TD is greater than a predetermined threshold value TDth which is previously set.

To explain in detail, the controller 100 calculates the temperature-decrease-amount TD in the predetermined unit time "tc" at the intervals of the sampling time "ts" while printing is in process. Here, the predetermined unit time "tc" is a time longer than the sampling time "ts", and the predetermined unit time "tc" is, for example, several hundred milliseconds to several seconds. The temperature-decrease-amount TD can be calculated by, for example, integrating values $\Delta TH$ obtained by subtracting a current value of the detected temperature TH from a previous value of the detected temperature TH over the unit time "tc", then, by dividing an integrated value $\Sigma\Delta TH$ by the unit time "tc". The temperature-decrease-amount TD may also be calculated by dividing a value obtained by subtracting a detected temperature TH (a current value) obtained this time (a current time) from a detected temperature TH obtained at a time before the current time by the unit time "tc". That is, the temperature-decrease-amount TD may be calculated by dividing an amount of decrease of the temperature over the unit time "tc" by the unit time "tc".

"While printing is in process" can be defined as, for example, a period from a timing, after the controller 100 receives a print job containing a command for starting printing and image data and starts supplying the sheet S, when a predetermined time "tp" passes from a timing of detection of the sheet S, by the sensor-after-registration 22, supplied from the sheet supplier 3 toward the image forming unit 4 to a timing when the sheet S on which the image is formed is discharged to the outside of the housing 2. The predetermined time "tp" can be set to, for example, a period of time from a timing of the detection of a leading distal end of the sheet S, by the sensor-after-registration 22, supplied from the sheet supplier 3 is detected to a timing when the leading distal end of the sheet S reaches a nip portion between the heating roller 81 and the pressure unit 82.

In a case where printing is continuously executed on a plurality of sheets S, "while printing is in process" can be defined as, for example, a period from a timing when the predetermined time "tp" passes from the detection of the first sheet S supplied from the sheet supplier 3 toward the image forming unit 4 by the sensor-after-registration 22 to a timing when the last sheet S is discharged to the outside of the housing 2.

The controller 100 calculates the temperature-decrease-amount TD at the intervals of the sampling time "ts" and determines whether the temperature-decrease-amount TD is greater than the predetermined threshold value TDth or not. Then, as a result of determination, the controller 100 stops conveyance of the sheet S when the temperature-decrease-amount TD is greater than the predetermined threshold value TDth. To explain in detail, when the temperature-decrease-amount TD is greater than the predetermined threshold value TDth, the controller 100 stops rotations of respective rollers in the sheet supplier 3, rotations of the photoconductive drums 61, rotation of the drive roller 71 in the transfer unit 7, rotation of the heating roller 81 in the fixing device 8, and the like, thereby stopping conveyance of the sheet S.

The controller 100 also stops heating of the sheet S by the heating roller 81 when the temperature-decrease-amount TD is greater than the predetermined threshold value TDth. To explain in detail, the controller 100 stops energizing the heaters 83, 84 to stop heating the heating roller 81 by the heaters 83, 84, thereby stopping heating of the sheet S by the heating roller 81.

The controls 100 notifies an occurrence of a sheet jam at the fixing device 8 when the temperature-decrease-amount TD is greater than the predetermined threshold value TDth and the conveyance of the sheet S is stopped. The controller 100 notifies the occurrence of the sheet jam at the fixing device 8 by, for example, displaying the occurrence of the sheet jam on a screen provided in the housing 2 while making an alarm sound from a speaker provided in the housing 2.

The method of notification is not limited to the above. For example, the controller 100 may notify the occurrence of the sheet jam at the fixing device 8 by emitting voice from a speaker. The controller 100 may also notify the occurrence of the sheet jam at the fixing device 8 by turning on or blinking a dedicated lamp provided in the housing 2.

In the embodiment, the controller 100 is configured to set the predetermined threshold value TDth in accordance with the inner-temperature TM obtained from the inner-temperature sensor 23. To explain in detail, when the inner-temperature TM is higher than a predetermined temperature TMth, the controller 100 sets the predetermined threshold value TDth to a value, an absolute value of which is less than a value, to be set when the inner-temperature TM is equal to or less than the predetermined temperature TMth. Specifically, the controller 100 sets the predetermined threshold value TDth to a first threshold TDthN when the inner-temperature TM is equal to or less than the predetermined temperature TMth, and sets the predetermined threshold value TDth to a second threshold value TDthS, an absolute value of which is less than the first threshold value TDthN, when the inner-temperature TM is higher than the predetermined temperature TMth.

In the embodiment, the controller 100 can execute a plurality of print modes in which conveyance speeds of the sheet S are different from each other. To explain in detail, the controller 100 can execute a full-speed mode which is a print mode for forming an image on plain paper or the like as the sheet S and a half-speed mode which is a print mode for forming an image on an envelope, thick paper, or the like as the sheet S. A conveyance speed of the sheet S in the half-speed mode is slower than a conveyance speed of the sheet S in the full-speed mode. Specifically, the conveyance speed of the sheet S in the half-speed mode is approximately half of the conveyance speed of the sheet S in the full-speed mode.

The controller 100 is configured to set the unit time "tc" in accordance with the conveyance speed of the sheet S. To explain in detail, when the conveyance speed of the sheet S is less than a predetermined speed, the controller 100 sets the unit time "tc" to a time longer than a time to be set when the conveyance speed of the sheet S is equal to or higher than the predetermined speed. For more details, the controller 100 sets the unit time "tc" in the half-speed mode to a time longer than the time in the full-speed mode. Specifically, the controller 100 sets the unit time "tc" to a first unit time tcN in the full-speed mode, and sets the unit time "tc" to a second unit time tcL which is longer than the first unit time tcN in the half-speed mode. The second unit time tcL is, for example, a time twice as long as the first unit time tcN.

Next, an example of the operation of the controller 100 will be explained with reference to a flowchart of FIG. 4.

Figure 4:
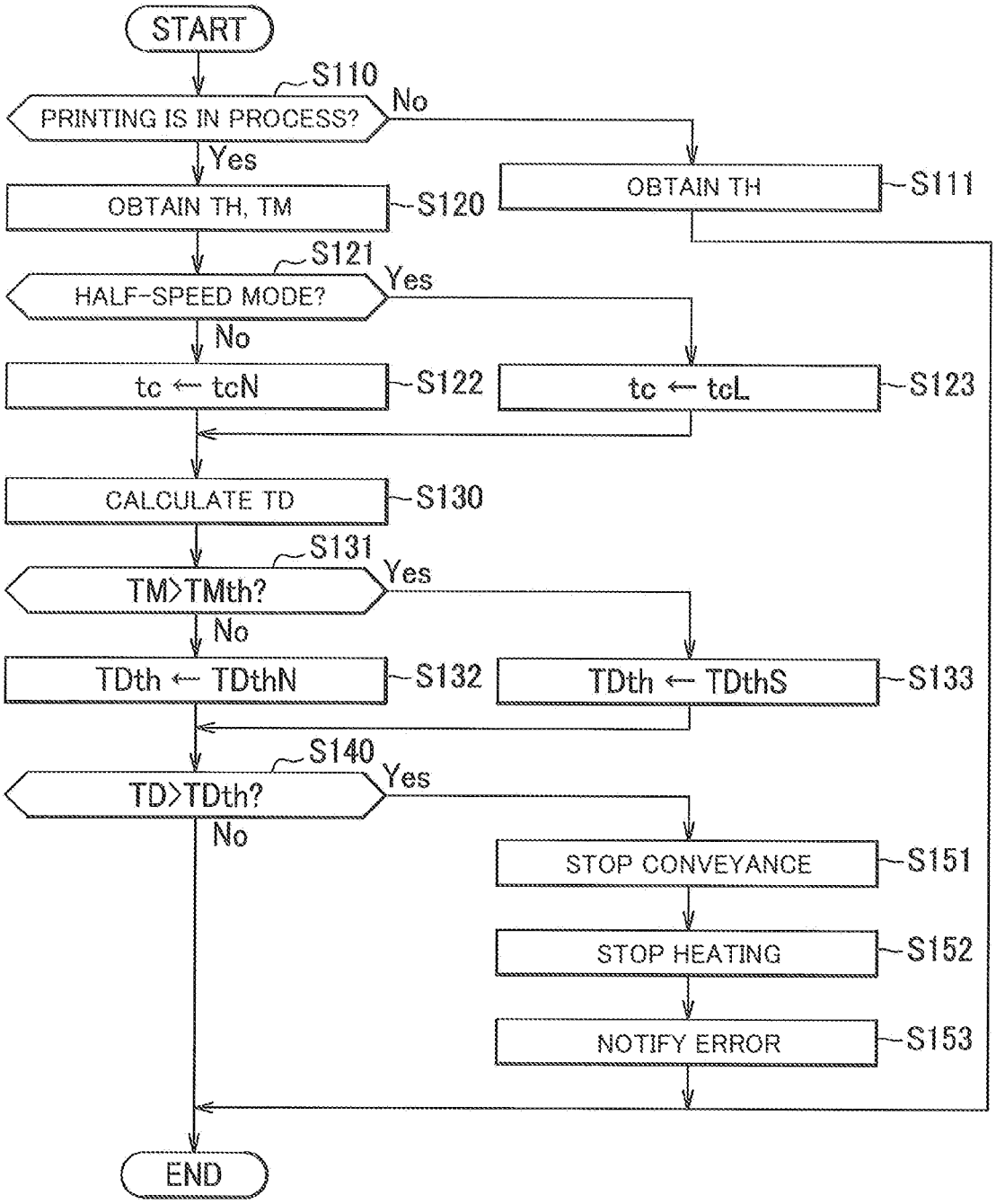
FIG. 4 is a flowchart illustrating an example of the operation of a controller.

The controller 100 executes a process illustrated in FIG. 4 at the intervals of the sampling time "ts" (a predetermined control cycle) repeatedly after the power supply of the image forming apparatus 1 is inputted.

As illustrated in FIG. 4, the controller 100 determines whether printing is in process or not (S110). When printing is not in process (S110, No), the controller 100 obtains the detected temperature TH detected by the temperature sensor 85 (S111), and ends the process of this time. When printing is in process (S110, Yes), the controller 100 obtains the detected temperature TH and the inner-temperature TM (S120).

Then, the controller 100 determines whether the print mode is the half-speed mode or not (S121). When it is determined that the print mode is not the half-speed mode (S121, No), that is, when the print mode is the full-speed mode, the controller 100 sets the unit time "tc" to the first unit time tcN (S122) and the process proceeds to Step S130. When it is determined that the print mode is the half-speed mode at Step S121 (Yes), the controller 100 sets the unit time "tc" to the second unit time tcL longer than the first unit time tcN (S123) and the process proceeds to Step S130.

The controller 100 calculates the temperature-decrease-amount TD at Step S130. For example, the controller 100 calculates the temperature-decrease-amount TD by integrating the values ΔTH obtained by subtracting a current value of the detected temperature TH from a previous value of the detected temperature TH (detected before the current time by the sampling time "tc") over the unit time "tc", then, by dividing an integrated value ΣθTH by the set unit time "tc".

The controller 100 also determines whether the inner-temperature TM is higher than the predetermined temperature TMth or not (S131). When it is determined that the inner-temperature TM is equal to or less than the predetermined temperature TMth (S131, No), the controller 100 sets the predetermined threshold value TDth to the first threshold value TDthN (S132) and the process proceeds to Step S140. When it is determined that the inner-temperature TM is higher than the predetermined temperature TMth at Step S131 (Yes), the controller 100 sets the predetermined threshold value TDth to the second threshold value TDthS less than the first threshold value TDthN (S133) and the process proceeds to Step S140.

The controller 100 determines whether the temperature-decrease-amount TD is greater than the set threshold value TDth or not at Step S140. When it is determined that the temperature-decrease-amount TD is equal to or less than the predetermined threshold value TDth (S140, No), the controller 100 ends the process of this time.

When it is determined that the temperature-decrease-amount TD is greater than the predetermined threshold value TDth at Step S140 (Yes), the controller 100 stops the rotation of the heating roller 81 and the like to stop conveyance of the sheet S (S151). The controller 100 also stops energizing the heaters 83, 84 to stop heating of the sheet S (S152). After that, the controller 100 notifies the occurrence of an error, specifically, the occurrence of the sheet jam at the fixing device 8 (S153) and ends the process illustrated in FIG. 4 once.

The controller 100 executes the process illustrated in FIG. 4 at the intervals of the sampling time "ts" repeatedly again when the user removes the sheet S (the sheet S wound around the heating roller 81) jammed at the fixing device 8.

According to the embodiment explained above, the temperature-decrease-amount TD of the detected temperature TH detected by the temperature sensor 85 is calculated by each sampling time "ts", and the conveyance of the sheet S is stopped when the calculated temperature decrease mount TD is greater than the predetermined threshold value TDth; therefore, the conveyance of the sheet S can be stopped immediately when wounding of the sheet S around the heating roller 81 occurs. Then, the temperature-decrease-amount TD is calculated not for the sampling time "ts" but for the unit time "tc" which is longer than the sampling time "ts"; therefore, the calculated temperature-decrease-amount TD is hardly affected by sudden change of temperature, as a result, it is possible to suppress false detection that winding of the sheet S around the heating roller 81 occurs.

Since heating of the sheet S by the heating roller 81 is stopped when the temperature-decrease-amount TD is greater than the predetermined threshold value TDth, it is possible to prevent the sheet S wound around the heating roller 81 from being heated excessively at the time of stopping the conveyance of the sheet S.

Since the temperature sensor 85 is not in contact with the heating roller 81, the temperature sensor 85 can be disposed in a range where the heating roller 81 contacts the sheet S (range of the contact area) in the width direction of the sheet S. Accordingly, it is possible to accurately detect winding of the sheet S around the heating roller 81.

Since the occurrence of the sheet jam at the fixing device 8 is notified when the temperature-decrease-amount TD is greater than the predetermined threshold value TDth and conveyance of the sheet S is stopped, it is possible to inform the user that the cause of stopping conveyance of the sheet S is in the fixing device 8. Accordingly, the user is allowed to easily take measures afterward, which can improve user friendliness of the image forming apparatus 1.

In the case where the inner-temperature TM is high, the temperature of the heating roller 81 does not easily decrease even when winding of the sheet S around the heating roller 81 occurs; therefore, the decrease in temperature of the heating roller 81 can be detected in an early stage by lowering the predetermined threshold value TDth (absolute value) in this case. Accordingly, it is possible to detect the occurrence of winding of the sheet S around the heating roller 81 in the early stage even when the inner-temperature TM is high.

In the case where the conveyance speed of the sheet S is low such as in the case where the print mode is the half-speed mode, decrease in temperature of the heating roller 81 occurring when winding of the sheet S around the heating roller 81 occurs becomes gradual; therefore, the temperature-decrease-amount TD is calculated while lengthening the unit time "tc", thereby detecting the decrease in temperature of the heating roller 81 more positively. Accordingly, it is possible to detect the occurrence of winding of the sheet S around the heating roller 81 more positively even when the conveyance speed of the sheet S is low.

Since the elastic layer 81B of the heating roller 81 is made softer than the second member 183 disposed downstream, the second member 183 can bite into the elastic layer 81B of the heating roller 81 through the endless belt 181. Accordingly, since a direction of the sheet S can be changed between the heating roller 81 and the second member 183 to peel off the sheet S from the heating roller 81, it is possible to suppress winding of the sheet S around the heating roller 81.

The embodiment has been explained above. The present disclosure is not limited to the above embodiment but can be used by being modified suitably as illustrated below.

For example, the conveyance of the sheet S and the heating of the sheet S by the heating roller 81 are stopped when the state where the temperature-decrease-amount TD is greater than the predetermined threshold value TDth occurs once in the above embodiment; however, the present disclosure is not limited to this. It is also preferable that the conveyance of the sheet S and the like may be stopped when the state where the temperature-decrease-amount TD is greater than the predetermined threshold value TDth occurs a plurality of times in a row. For example, the conveyance of the sheet S and the like may be stopped when the state where the temperature-decrease-amount TD is greater than the predetermined threshold value TDth occurs two times in a row, or the conveyance of the sheet S and the like may be stopped when the state where the temperature-decrease-amount TD is greater than the predetermined threshold value TDth occurs two times or more in a row.

Moreover, the heating of the sheet S by the hearing roller 81 is stopped when the temperature-decrease-amount TD is greater than the predetermined threshold value TDth in the above embodiment; however, the present disclosure is not limited to this. It is also preferable to apply a configuration in which the heating of the sheet S by the heating roller 81 is not completely stopped. For example, when the temperature-decrease-amount TD is greater than the predetermined threshold value TDth, an output of the heaters 83, 84 may be reduced to be less than an output in the case of the print mode in which the image is formed on the sheet S (before winding of the sheet S around the heating roller 81 occurs) by lowering a control target temperature of the heaters 83, 84, such as in a case of a ready mode in which an input of the print job is waited for.

The fixing device 8 includes the temperature sensor 85 in the above embodiment; however, the present disclosure is not limited to this. For example, the temperature sensor may be provided separately from the fixing device.

Two kinds of modes which are the full-speed mode and the half-speed mode are executable as print modes in which the conveyance speeds of the sheet S differ in the above embodiment; however, the present disclosure is not limited to this. For example, three or more kinds of print modes in which the conveyance speeds of the sheet differ may be executable. In this case, the unit time may be changed according to the print mode. For example, the unit time may be set to be longer as the conveyance speed of the sheet becomes low. It is also preferable that the image forming apparatus does not execute a plurality of print modes in which the conveyance speeds of the sheet S differ. In this case, a configuration in which the unit time is not changed may be adopted.

The predetermined threshold value TDth is set to the first threshold value TDthN or the second threshold value TDthS in accordance with the inner-temperature TM in the above embodiment; however, the present disclosure is not limited to this. For example, the predetermined threshold value may be set to a lower value as the inner-temperature becomes high from three or more values which are previously set. It is also preferable to adopt a configuration in which the predetermined threshold value is not changed, and a configuration in which the inner-temperature sensor is not provided may be adopted in this case.

The temperature-decrease-amount TD is calculated by integrating the values ΔTH obtained by subtracting a present value from a previous value of the detected temperature TH over the unit time "tc", then, by dividing an integrated value ΣΔTH by the unit time "tc", or by dividing the value obtained by subtracting a detected temperature TH obtained this time from a detected temperature TH obtained at the time before the current time by the unit time "tc"; however, the present disclosure is not limited to this. For example, the integrated value ΣΔTH may be set as the temperature-decrease-amount TD, or the value obtained by subtracting the detected temperature TH obtained this time from the detected temperature TH obtained at the time before the current time by the unit time "tc" may be set as the temperature-decrease-amount TD.

The configuration in which the heating roller 81 has the elastic layer 81B on the outer circumference thereof is adopted in the above embodiment; however, the present disclosure is not limited to this. For example, the heating roller may have a configuration in which the elastic layer is not provided on the outer circumference thereof.

The hardness differs between the first member 182 and the second member 183 in the above embodiment; however, the present disclosure is not limited to this. For example, the hardness of the first member 182 and the hardness of the second member 183 may be the same.

The fixing device 8 including the pressure unit 82 which has the endless belt 181 and the first and second members 182, 183 is illustrated as an example in the above embodiment; however, the present disclosure is not limited to this.

For example, the fixing device 8 may include a pressure roller having a core metal and an elastic layer formed on an outer circumference of the core metal instead of the pressure unit 82 according to the embodiment.

In the above embodiment, the occurrence of the sheet jam at the fixing device 8 is specified and a message indicating the occurrence of the sheet jam is notifies when the temperature-decrease-amount TD becomes greater than the predetermined threshold value TDth and the conveyance of the sheet S is stopped; however, the present disclosure is not limited to this. For example, it is also preferable to adopt a configuration in which the occurrence of the sheet jam at the fixing device 8 is not specified and a message merely indicating that the sheet jam occurs in the apparatus is notified.

The color printer is illustrated as an example of the image forming apparatus in the above embodiment; however, the present disclosure is not limited to this. For example, the image forming apparatus may be a monochrome printer capable of forming only monochrome images. Moreover, the image forming apparatus is not limited to the printer but may also be, for example, a copy machine, a multifunction device, and the like.

Respective components explained in the above embodiment and modification examples may be arbitrarily combined to be achieved.

What is claimed is:

1. An image forming apparatus, comprising:

a fixing device including a heating roller configured to heat a sheet when the heating roller rotates;

a temperature sensor configured to detect a temperature of the heating roller; and a controller configured to:

obtain a temperature detected by the temperature sensor at intervals of a predetermined sampling time and calculate, at the intervals of the predetermined sampling time, a temperature-decrease-amount of the detected temperature over a unit time that is longer than the predetermined sampling time; and stop rotation of the heating roller when the calculated temperature-decrease-amount is greater than a predetermined threshold value.

2. The image forming apparatus according to claim 1, wherein the controller is configured to stop heating of the sheet by the heating roller when the temperature-decease-amount is greater than the predetermined threshold value.

3. The image forming apparatus according to claim 1, wherein the temperature sensor is not in contact with the heating roller.

4. The image forming apparatus according to claim 1, wherein the controller is configured to notify a sheet jam occurred at the fixing device when the temperature-decrease-amount is greater than the predetermined threshold value and the conveyance of the sheet is stopped.

5. The image forming apparatus according to claim 1, further comprising an inner-temperature sensor configured to detect an inner-temperature which is a temperature inside the image forming apparatus, wherein the controller is configured to set the predetermined threshold value in accordance with the detected inner-temperature.

6. The image forming apparatus according to claim 5, wherein, when the inner-temperature is higher than a predetermined temperature, the controller is configured to set the predetermined threshold value to a value less than a value to be set when the inner-temperature is equal to or less than the predetermined temperature.

7. The image forming apparatus according to claim 1, wherein the controller is capable of executing a plurality of print modes in which conveyance speeds of the sheet in the plurality of print mode are different, and is configured to set the unit time in accordance with the conveyance speed.

8. The image forming apparatus according to claim 7, wherein, when the conveyance speed is less than a predetermined speed, the controller is configured to set the unit time to a time longer than a time to be set when the conveyance speed is equal to or greater than the predetermined speed.

9. The image forming apparatus according to claim 1, wherein the fixing device includes:

an endless belt configured to convey the sheet in a conveying direction when the sheet is nipped between the endless belt and the heating roller; and a first member, and wherein the endless belt is interposed between the first member and the heating roller.

10. The image forming apparatus according to claim 9, wherein the first member is made of an elastic material.

11. The image forming apparatus according to claim 10, wherein the heating roller includes an elastic layer on an outer circumference of the heating roller, and wherein the elastic layer is harder than the first member.

12. The image forming apparatus according to claim 9, wherein the fixing device includes a second member disposed upstream of the first member in the conveying direction, and wherein the endless belt is interposed between the second member and the heating roller.

13. The image forming apparatus according to claim 12, wherein the second member is made of an elastic material.

14. The image forming apparatus according to claim 13, wherein the heating roller includes an elastic layer on an outer circumference of the heating roller, and wherein the elastic layer is softer than the second member.

15. The image forming apparatus according to claim 1, wherein the conveyance of the sheet is stopped by stopping rotation of the heating roller.

16. A method for controlling an image forming apparatus including a heating roller configured to heat a sheet when the heating roller rotates, the method comprising:

detecting a temperature of the heating roller at intervals of a predetermined sampling time in a state in which the heating roller rotates;

obtaining, at the intervals of the predetermined sampling time, a temperature-decrease-amount of the detected temperature of the heating roller over a unit time that is longer than the predetermined sampling time; and stopping rotation of the heating roller when the temperature-decrease-amount is greater a predetermined threshold value.

17. The method according to claim 16, further comprising stopping heating by the heating roller when the temperature-decrease-amount is greater than the predetermined threshold value.

* * * * *